US006978894B2

(12) United States Patent
Mundt

(10) Patent No.: US 6,978,894 B2
(45) Date of Patent: Dec. 27, 2005

(54) BLISTER PACKAGE FOR PHARMACEUTICAL TREATMENT CARD

(75) Inventor: James M. Mundt, Warrington, PA (US)

(73) Assignees: Merck & Co., Inc., Rahway, NJ (US); Sharp Corporation, Conchohocken, PA (US)

( * ) Notice: Subject to any disclaimer, the term of this patent is extended or adjusted under 35 U.S.C. 154(b) by 339 days.

(21) Appl. No.: 09/737,327

(22) Filed: Dec. 15, 2000

(65) Prior Publication Data

US 2001/0030140 A1 Oct. 18, 2001

(51) Int. Cl.[7] ..... B65D 83/04

(52) U.S. Cl. ..... 206/534; 206/532; 206/539; 424/400

(58) Field of Search ..... 206/531, 532, 206/534, 538, 539, 461, 459.5, 232; 424/400, 405

(56) References Cited

U.S. PATENT DOCUMENTS

| | | | |
|---|---|---|---|
| 3,504,788 | A | 4/1970 | Gray |
| 3,527,190 | A | 9/1970 | Huck |
| 3,677,397 | A | 7/1972 | Beckham |
| 4,199,569 | A | 4/1980 | Chabala et al. |
| 4,243,144 | A | 1/1981 | Margulies |
| 4,295,567 | A | 10/1981 | Knudsen |
| 4,340,141 | A | 7/1982 | Fischer |
| 4,425,339 | A | 1/1984 | Pitchford |
| 4,506,789 | A | 3/1985 | Dlugosz |
| 4,534,468 | A | 8/1985 | Nuckols et al. |
| 4,573,580 | A | 3/1986 | Messer |
| 4,736,849 | A | 4/1988 | Leonard et al. |
| 4,761,406 | A | 8/1988 | Flora et al. |
| 4,848,582 | A | 7/1989 | Levasseur et al. |
| 4,889,237 | A | 12/1989 | Brandon |
| 4,889,238 | A | 12/1989 | Batchelor |

(Continued)

FOREIGN PATENT DOCUMENTS

| | | |
|---|---|---|
| CA | 866616 | 3/1971 |
| EP | 0 511 726 A2 | 11/1992 |
| FR | 2635507 | 2/1990 |
| GB | 1580583 | 12/1980 |
| GB | 2256853 A | 12/1992 |
| WO | WO 97/03896 | 2/1997 |
| WO | WO 98/00351 | 1/1998 |
| WO | WO 98/22072 | 5/1998 |
| WO | WO 99/04773 | 2/1999 |
| WO | WO 99/51214 | 10/1999 |

OTHER PUBLICATIONS

Greenberg, Clin. Therap., vol. 6 (1984), "Overview of patient compliance with medication dosing: A literature Review", pp. 592–599.

Schnitzer et al., Aging Clin. Exp. Res., vol. 12 (2000), pp. 1–12, "Therapeutic equivalence of alendronate 70 mg once–weekly and alendronate 10 mg daily in the treatment of osteoporosis".

Adami et al., 6th Int'l Symposium on Clinical Disorders of Bone and Mineral Metabolism, Nov. 1999, "Rationale for once weekly dosing regiments wit alendronate for the treatment and prevention of osteoporosis", p. 48.

(Continued)

*Primary Examiner*—John G. Weiss
*Assistant Examiner*—Michael J. Fisher
(74) *Attorney, Agent, or Firm*—Dianne Brown; Mark R. Daniel; Michael J. Bonella

(57) ABSTRACT

A blister package for a pharmaceutical treatment card suitable, the blister package having a plurality of individual blisters suitable for containing a pre-measured dosage of a pharmaceutical composition in the form of tablets, pills and capsules. In accordance with a pre-determined schedule of administration of the individually sealed blisters may be opened by a method of tearing, peeling and pushing. The blister card package can be characterized as a multiple layer laminate assembly having a plurality of transparent cavities containing composition.

26 Claims, 4 Drawing Sheets

U.S. PATENT DOCUMENTS

| | | | | | |
|---|---|---|---|---|---|
| 4,974,729 | A | | 12/1990 | Steinnagel | |
| 5,050,739 | A | | 9/1991 | Hannan et al. | |
| 5,242,055 | A | | 9/1993 | Pora | |
| 5,265,728 | A | | 11/1993 | Allendorf et al. | |
| 5,339,960 | A | | 8/1994 | Price | |
| 5,393,100 | A | | 2/1995 | Coe | |
| RE35,445 | E | * | 2/1997 | Pora | 206/534 |
| 5,755,462 | A | | 5/1998 | Lupi | |
| 5,830,490 | A | * | 11/1998 | Weinstein et al. | 206/534 |
| 5,833,072 | A | | 11/1998 | Lambelet, Jr. | |
| 5,908,208 | A | * | 6/1999 | Lapsker | 206/232 |
| 5,915,559 | A | | 6/1999 | Hulicks et al. | |
| 5,927,500 | A | | 7/1999 | Godfrey et al. | |
| 5,994,329 | A | | 11/1999 | Daifotis et al. | |
| 6,024,222 | A | | 2/2000 | Friberg et al. | |
| 6,375,225 | B1 | * | 4/2002 | Lapsker | 206/534 |
| 6,375,956 | B1 | * | 4/2002 | Hermelin et al. | 424/400 |
| 6,382,420 | B1 | * | 5/2002 | Bouthiette | 206/534 |

OTHER PUBLICATIONS

Bone III et al., 6th Int'l Symposium on Clinical Disorders of Bone and Mineral Metabolism, Nov. 1999, "Alendronate 70 mg once weekly is therapeutically equivalent to alendronate 10 mg daily", p. 55.

Copy of dispenser package and insert for Heartgard 30® (ivermectin) chewables, Merck & Co., Inc., Oct. 1988.

Veterinarian, treatment card incorporating a blister package characterized as a laminated structure (Product #51191).

* cited by examiner

BLISTER PACKAGE FOR PHARMACEUTICAL TREATMENT CARD

FIELD OF THE INVENTION

The present invention is relates to a child resistant, blister package suitable for incorporation into a pharmaceutical treatment card, wherein a plurality of individually sealed, blister cavities each containing a single dosage of a pharmaceutical composition in the form of pills, tablets, capsules, etc. Generally, the pharmaceutical treatment card will also contain literature regarding the composition.

BACKGROUND OF THE INVENTION

Many forms of dispensing containers and storage vessels for pharmaceutical compositions have been introduced to the market in recent years. Pharmaceutical compositions, particularly those in the form of pre-measured tablets, pills, powders and capsules, have been dispensed from vials, bottles, or blister packages.

Recently, blister packages have been designed to be child resistant. That is, the packages have been designed to be particularly resistant to opening by younger children yet manageable for an adult. In many cases, multiple steps must be performed in sequence to open a child safety blister package. Another convenience of a child safety, blister package is that individual dosages of a composition can be separately sealed in blister cavities, each cavity having the child safety feature. After administration of a dosage of composition, the empty portion of a blister cavity can be removed and disposed. Along with instructions and scheduling information that can be included in the pharmaceutical treatment card, the blister package can serve as an aid for self-administration of a composition as prescribed.

Presently, there is needed a pharmaceutical treatment card incorporating a child resistant, blister package assembly therein. Generally, the child resistant, blister package must be difficult for young children, e.g. ranging of about 27 to about 60 months of age, to open. A pharmaceutical treatment card incorporating a blister package can provide useful instruction and information on the covers thereof, as well as a means of safely securing the composition within the blister package against child tampering.

U.S. Pat. No. 5,927,500 to Godfrey et al., issued Jul. 27, 1999 suggest a pharmaceutical containment package characterized by cover and backing layers constructed of a reinforcing fabric substrate having a blister card disposed there between. However, Godfrey et al. fails to provide a child resistant blister within the package. Generally, an individual dosage of a pharmaceutical composition can be pushed through a perforated backing conforming to the general shape of the dosage.

U.S. Pat. No. 5,775,505 to Hofmann et al., issued Aug. 26, 1998 teaches a childproof, blister package, characterized as a multiple layer assembly, having a 2×3 array of individually sealed, blister cavities with vertical and horizontal, perforation lines for separating each blister pack. At the intersections of vertical and horizontal perforation lines, there are cavities wherein the layers thereunder are unsealed. Separation of a section of the package produces a pull-tab from the unsealed area, wherein pulling the tab separates the layer from the blister cavity to expose a pill.

PCT publication WO 97/02192, published Mar. 16, 1999 suggest a multiple layer blister pack having a 2×8 array of individual, blister cavities. The pack has a lid foil layer connected to a base foil layer with two parallel and offset rows of individual blisters, wherein perforation lines on each side of the lid foil divide the blister rows, and perforation lines, perpendicular to the lid foil layer divide each offset row. At each intersection of parallel and perpendicular, perforation lines, there is a notch cavity. In removing a pill from a blister cavity, an individual blister is separated from the pack along the perforation lines, exposing the layers underneath the notch cavity. The layers peel away from the blister cavity to dislodge the pill.

There is a need for a more advanced blister package. A package that provides adequate sealing and child safety, yet manageable for an adult to easily open. The inclusion of blister package can be adapted to fit into a pharmaceutical treatment card that includes a regimen for administering the composition to a patient in need thereof.

The present invention provides a childproof blister package suitable for containing a pharmaceutical composition in the form of pills, tablets, capsules, etc. The package requires additional steps to manipulate the components thereof to dislodge a pill therefrom.

SUMMARY OF THE INVENTION

The present invention is directed to a blister package incorporated into a pharmaceutical treatment card for dispensing a pre-measured dosage of a pharmaceutical composition, the card is characterized as a uniform edge, multiple layer, laminate assembly comprising, proportionally dimension, first and second sides divided by hinge means, said first and second sides comprising, interior and exterior layers, said second side further comprising a blister package affixed between said interior and exterior layers along an edge of the second side opposite the hinge means, said blister package comprising:

a) a blister layer comprising a plurality of raised, blister cavities conforming to the shape of a pharmaceutical composition contained therein, wherein the blister cavities extend beyond the surface of the blister layer;

b) a lidding layer attached to the blister layer on a side opposite the blister cavity for containing the pharmaceutical composition within the blister cavity;

c) a peelable, backing layer abutting the lidding layer opposite the blister layer;

d) a plurality of adhesive layers between each of the interior and blister layers, blister and lidding layers, backing and exterior layers, said adhesive layers being suitable for affixing the layers together, except that substantially no adhesive layer is between the lidding and backing layers;

e) hinge means between the first and second sides of the card;

f) a plurality of first, perforation lines being about perpendicular to the hinge means and extending through the blister, lidding, peelable and adhesive layers, and between each blister cavity for separating the individual blister cavity to form quadrants;

g) a plurality of notch cavities located in the blister layer, each notch cavity being adjacent to and associated with a blister cavity and located along the first, perforation lines, said notch cavities being of equal or less volume to the blister cavity volume, so that a void exists between the notch cavity and the lidding layer;

h) a continuous second, perforation line extending through the blister, lidding, peelable backing, adhesive, interior and exterior layers, and along the uniform edge of the second side opposite the hinge means to form a barrier strip so that a portion of the barrier strip extends through each notch cavity, wherein the second, perforation line is about perpendicular to and intersects the first, perforation line at a notch cavity;

i) a tab consisting essentially of an area proximal to the notch cavities wherein the lidding and backing layers are affixed together by an adhesive;

j) a barrier strip consisting essentially of a laminate assembly of the interior, exterior, blister, lidding and backing layers adhered together, said barrier strip being an area of the second side of the card parallel and most opposite the hinge means, said barrier strip and second side being divided by the second, perforation line; and k) a cut out surface of the interior and exterior layers within the second side of the card proximal to the blister package wherein said layers have been removed to expose the blister and notch cavities, first and second perforated lines, wherein an individual blister cavity being opened by a method of tearing away a portion of the barrier strip to expose a portion of a notch cavity, clasping the tab in the region of the notch cavity, peeling said backing layer away from the lidding layer and towards the composition to expose the lidding layer, and pushing the blister cavity towards the composition to cause the composition to rupture the lidding layer thereby exposing the composition. The pharmaceutical treatment card will generally contain instructions and aides to assist a patient in administering an individual dosage of the pharmaceutical composition in a timely manner.

DETAILED DESCRIPTION OF THE INVENTION

Figure 1:
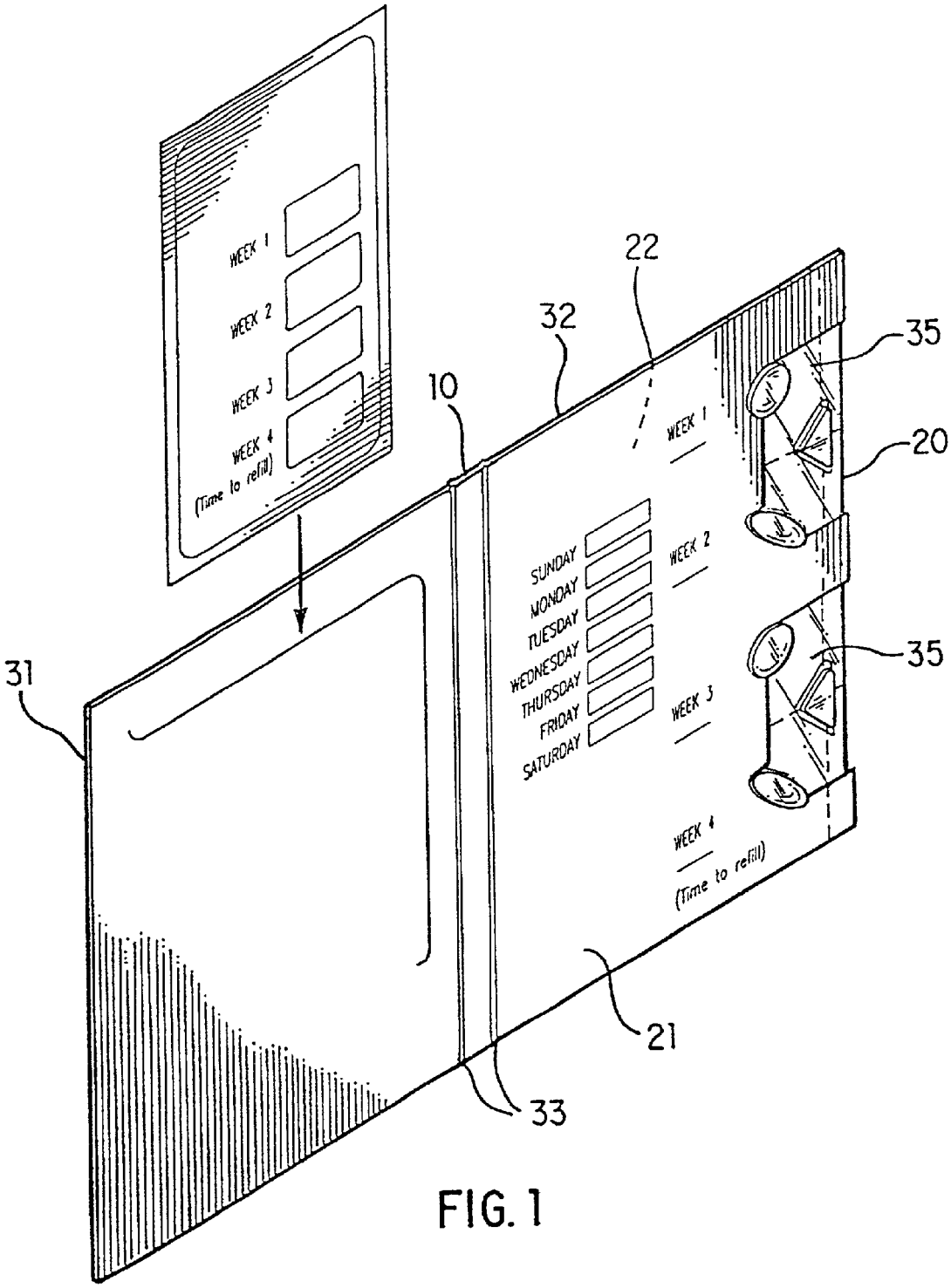
FIG. 1 illustrates a perspective view in elevation of an embodiment of the pharmaceutical treatment card (10), wherein the second, interior side of the card contains blister package (20)

The invention described herein is directed to a pharmaceutical treatment card having incorporated therein a child resistant, blister package. The pharmaceutical treatment card has the advantages of containing, in addition to individual pre-measured dosages of a pharmaceutical composition, indicia thereon to assist a patient in timely administer the composition as scheduled. Generally, these cards will contain one weekly prescription (a single dosage per day) or one monthly prescription (single or multiple dosages per week); preferably a 4 unit dosage card.

The blister package associated with the card the present invention can be characterized as containing a plurality of individually sealed, child resistant blister cavities arranged in a quadrant fashion. The individual blisters packs can be opened according to a method of peeling, tearing and pushing the various layers of a multiple layer laminate assembly that characterizes the blister package.

As used herein the term "uniform edge" is defined as edges of individual layers that are attached together to form a single structure, wherein the edges of several layers in a laminated structure can be affixed together to form one edge.

The term "multiple layer laminate" is defined as a structure having a plurality of separate layers affixed together to form a single layered unit.

As used herein the term "proportionally dimension sides" means opposing first and second sides of a card that can be identical in shape and size, or generally conform to similar shape but of different sizes.

The term "interior layer" is defined as the inside surface of the first or second side of a pharmaceutical card that abut one another other when the card is folded along its hinge means. The interior layer can contain indicia in the form of literature and instructional materials, as well as methods of assisting a user to schedule dosage administration intervals.

The term "exterior layer" is defined as the outside surface of a pharmaceutical card, when folded along its hinge means, that can contain indicia in the form of literature and instructional materials, as well as methods of assisting a user to schedule dosage administration intervals.

The term "sealed" as used herein when referring to the blister cavity is defined as an air tight and moisture proof blister cavity having several months shelf life.

As used herein the term "hinge means" means creases, lines or other folding properties incorporated into a pharmaceutical card where the card can be folded along bifurcated sides to define interior and exterior sides thereof.

The term "about perpendicular" is defined as a line that is within an angle of about 30 to about 60 degrees to a reference line or means.

As used herein the term "about parallel" is defined as a lines or means that is within an angle of about 30 to about 60 degrees to a base reference line or means.

The term "proximal" is defined as a first component that is about adjacent or sufficiently close to a second component of the card.

The phrase "cut out surface" refers to removed portions of the interior and exterior layers of the second side of the card in the region of the blister package that has been removed to expose the blister and backing layers of said package. In the 'cut out surface' the blister and notch cavities as well as the first, perforation lines are visible.

Referring to FIG. 1, pharmaceutical card (10) is characterized as a uniform edge, multiple layer laminate having proportionally dimension, first (31) and second (32) sides divided by hinge means (33). The first and second sides are characterized by interior (21) and exterior (22) surfaces. On the second side, blister package (20) is affixed between the interior and exterior surfaces. Cut out surface (35) of the blister package exposes the blister and notch cavities.

Figure 2:
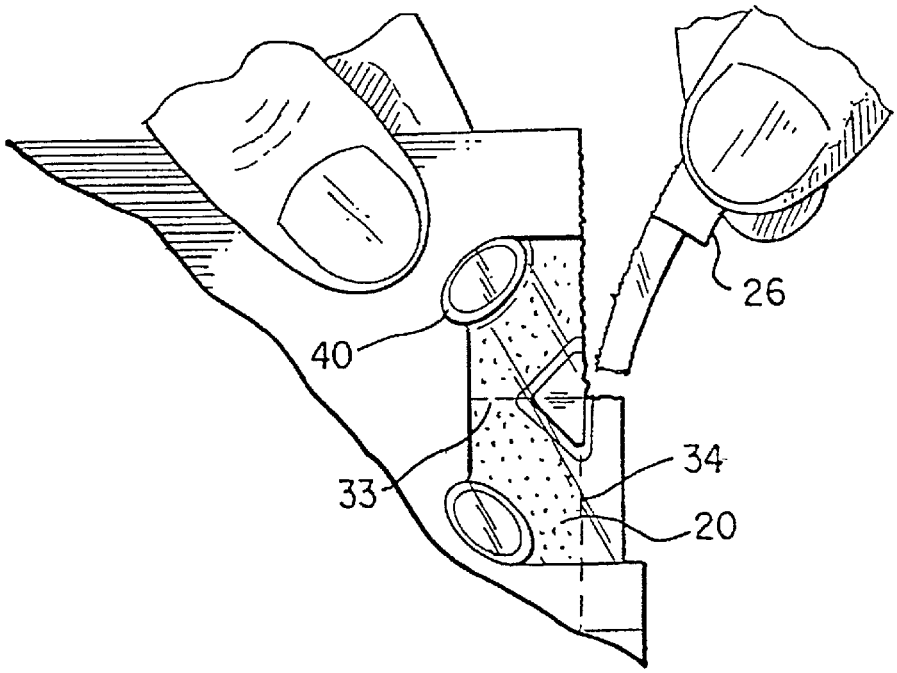
FIG. 2 illustrates a front view in elevation of blister package (20), wherein barrier strip (26) is being torn along perforation line (34) from card (10) to remove an individual dosage of pharmaceutical composition (40)

Referring to FIG. 2, barrier strip (26) is being torn from an edge of the card along second, perforation line (34) and a first, perforation line (33) to expose a the multiple layer laminate in the region notch cavity (28). While the card's interior and exterior layers are held between the finger and thumb of a user's first hand in an area of the card proximal to the blister package, the barrier strip can be torn away at the desired individual blister cavity using the second hand.

Figure 3:
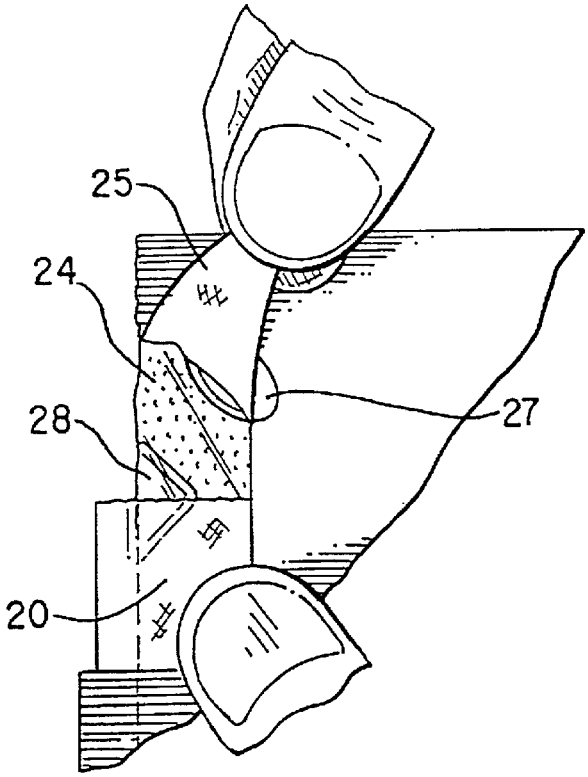
FIG. 3 illustrates a rear view in elevation of blister package (20), wherein peelable backing layer (22) is being peeled away from corner notch (28) to expose lidding layer (25)

Referring to FIG. 3, backing layer (25) and a small section of lidding layer (24) are being peeled away from notched cavity (28) towards blister cavity (27) to expose lidding layer (24). While the thumb and fingers of user's first hand grasp the second side of the card, the fore finger and thumb of the user's second hand can grasp a tab comprising an adhered portion of the lidding and backing layers underneath the notch cavity and peels the backing layer away from the notch cavity and towards the blister cavity holding a dosage of the pharmaceutical composition.

Figure 4:
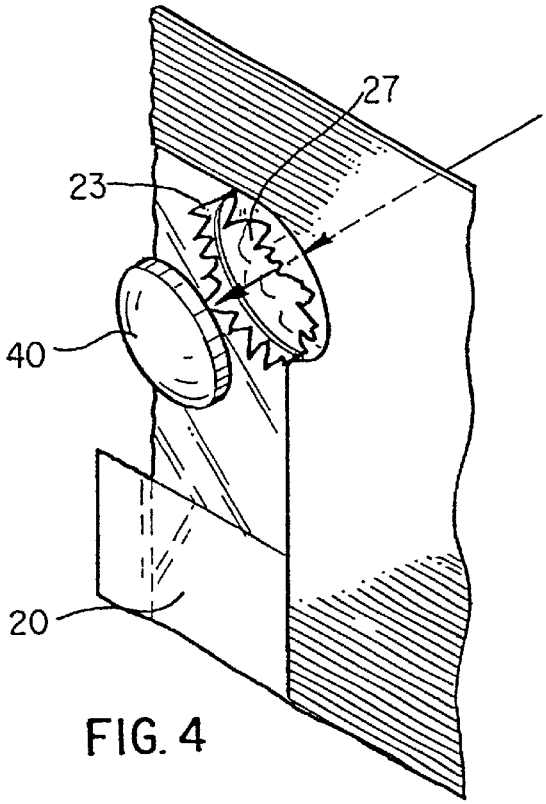
FIG. 4 illustrates a rear view in elevation of blister package (20) wherein pharmaceutical composition (40) contained in blister cavity (27) is being pushed through lidding layer (25)

Referring to FIG. 4, blister package (20) is shown wherein composition (40) is pushed from the blister cavity (27) through lidding layer (23) to dislodge the composition from an individual blister cavity. While at least one finger and thumb of a user's first hand grasp the card proximal to the desired blister cavity, the thumb of the user's second hand can be utilized to push against the blister cavity, wherein the blister cavity presses against the composition and cause it to contact the lidding layer, rupturing the layer to force the composition therethrough.

Figure 5:
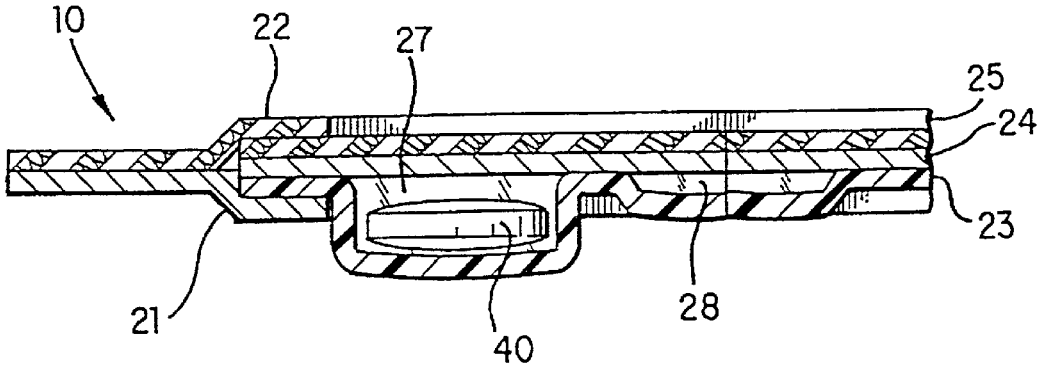
FIG. 5 illustrates a side view in detail of an embodiment of blister package affixed to pharmaceutical card (10), wherein the interior layer (21), blister layer (23), lidding layer (24), backing layer (25), and exterior layer (22) encapsulating pharmaceutical composition (40) are shown.

Referring to FIG. 5, blister package (20) is shown in detail as a multiple layer laminated assembly containing an individually, sealed blister cavities (27) containing a pre-measured dosage of a pharmaceutical composition (40). Referring to the layers, the interior layer (21) and exterior layer (22) of the second side of the card provide outer most layers for attachment of the blister package to the card. Immediately adjacent to the interior layer is blister layer (23) characterized as having a plurality of individual blister cavities (27) and a plurality of notch cavities (28) incorporated therein. The interior and blister layers are affixed together by an adhesive. Opposite the interior layer and adjacent to the blister layer is lidding layer (24), wherein a single dosage of pharmaceutical composition (40), located within the blister cavity, is held in place by the lidding layer. The blister and lidding layers are sealed together by an adhesive. Opposite the blister layer and next to the lidding layer is peelable backing layer (25). The lidding and peelable, backing layers are in direct contact with one another without the benefit of an adhesive, except that area of the lidding and backing layers proximal to the notch cavity is attached by an adhesive to form a pull tab. Opposite the lidding layer and next to the peelable backing layer is exterior layer (22) of the card. The peelable backing and exterior layers are held together by an adhesive. The barrier strip (26) is a composite of layers 21, 22, 23, 24 and 25 that have been adhered together (see FIG. 1).

Figure 6:
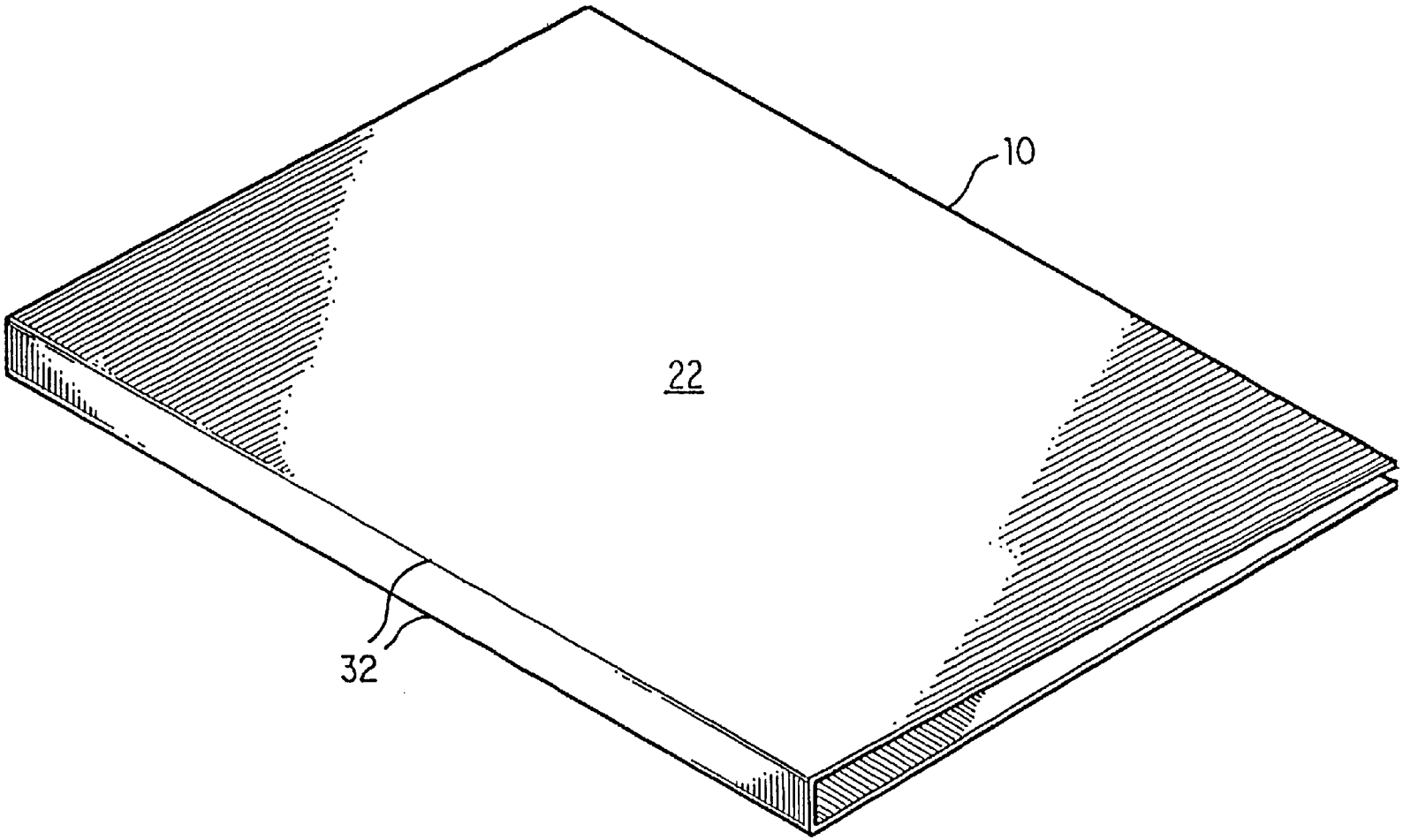
FIG. 6 illustrates a perspective view in elevation of the pharmaceutical treatment card (10) folded along hinge means (33), wherein exterior surface (22) is shown.

Referring to FIG. 6, the pharmaceutical treatment card is folded along hinge means (33) to place the card in a closed position, wherein exterior layer (22) of the first side of the card is shown.

One preferred embodiment of the present invention is directed to a blister package incorporated into a pharmaceutical treatment card, the card characterized as a uniform edge, two layer laminate assembly comprising, proportionally dimension, rectangular-shaped first and second sides divided by hinge means, said first and second sides comprising, interior and exterior layers, the second side further comprising a blister package affixed between said interior and exterior layers along the outer edge thereof, about parallel and opposite to the hinge means, said blister package comprising:

a) a blister layer consisting essentially of a plurality of aligned, raised, blister cavities conforming to the shape of a pharmaceutical composition placed therein selected from the group consisting of pills, tablets and capsules, said aligned cavities being about parallel and adjacent to the outer edge of the second side;

b) a lidding layer attached to the non-raised, cavity side of the blister layer for encapsulating the pharmaceutical composition therein;

c) a peelable, backing layer abutting the lidding layer opposite the blister layer;

d) a plurality of adhesive layers between each of the interior and blister layers, blister and lidding layers, and backing and exterior layers, said adhesive layers being suitable for affixing the layers together;

e) hinge means between the first and second sides of the card;

f) a plurality of first, perforation lines being about perpendicular to the hinge means and parallel to one another, said lines extending through the blister, lidding, peelable and adhesive layers, and between each blister cavity for separating the individual blister cavity to form quadrants;

g) a plurality of notch cavities located in the blister layer, each notch being adjacent to a raised blister cavity, along the first, perforation lines that separate each blister cavity, said notch cavities being of equal or less volume than the blister cavities, so that a void exists between the notch cavity and the lidding layer;

h) a continuous second, perforation line extending through the blister, lidding, peelable backing, adhesive, interior and exterior layers, and along the uniform edge of the second side opposite the hinge means to form a barrier strip so that a portion of said barrier strip extends through each notch cavity, wherein the second, perforation line is about perpendicular to and intersects the first, perforation line at a notch cavity;

i) a tab consisting essentially of an area proximal to the notch cavities wherein a portion of the lidding and backing layers are affixed together by an adhesive;

j) a barrier strip consisting essentially of a laminate assembly of the interior, exterior, blister, lidding and backing layers adhered together, said barrier strip being an area of the second side of the card that is parallel and most opposite the hinge means, said barrier strip and second side being divided by the second, perforation line; and k) a cut out surface comprising the interior and exterior layers within the second side of said card proximal to the blister package, wherein said layers have been removed to expose the blister and notch cavities, first and second perforated lines, wherein an individual blister cavity being opened to expose the composition therein by a method characterized by tearing away a portion of the barrier strip to expose a notch cavity, pealing the backing layer away from the barrier strip and towards the composition to expose the lidding layer, and pushing the composition from the blister cavity layer through the lidding layer thereby rupturing the lidding layer to expose the composition.

Multiple Layer Laminate

The interior and exterior layers of the pharmaceutical treatment card are generally constructed of a paper or polymeric material suitable for incorporating indicia in the form of printed media thereon. Typically, the interior and exterior layers can be fabricated from a paperboard or polymeric stock materials. The paper board material can be selected from the group consisting of cardboard, bristle board and corrugated paper. The polymeric stock material can be suitably selected from the group consisting of polyacetal, polyolefins, polystyrene, polyvinylchloride and blends thereof; a particularly preferred material in a paper board.

The blister layer of the blister package is generally a transparent and flexible polymeric material having a plurality of individual blister and notch cavities formed therein. Typically, the blister cavity is of sufficient volume or size to contain a single, pre-measured dosage of a pharmaceutical composition therein, wherein the composition is typically a pill, tablet, capsule or the like. The notch cavity can be of equal volume or size as the blister cavity, however, it is generally smaller in volume. The notch cavity provides a void space between the blister and the lidding layers, wherein the user can grasp a tab formed by adhering the lidding and backing layers to remove the backing layer. The blister layer can be constructed of a polymeric material such as low density polyethylene or an olefinic copolymer selected from the group consisting of ethylene-vinyl acetate, ethylene-acrylic acid, ethylene-ethyl acrylate, and blends thereof, polyamides, polypropylene, polyacetal, polybutylene terephthalate, polyethylene terephthalate, nylons and polyester. Various flouropolymers exhibiting transparency and flexibility can also be useful in fabricating the blister layer.

The lidding layer of blister package can be characterized as the component of the multiple layer assembly abutting the blister layer that retains the pharmaceutical dosage within the blister cavity. Generally, the lidding layer of the laminated assembly can be constructed of a relatively thin sheet of a sterile, non-moisture absorbing material, suitable for rupturing with little pressure applied thereto. Typically, the lidding layer can be constructed of a metallic foil material such as aluminum, polyester, papers and polyvinyl chloride; a preferred lidding layer material is aluminum foil.

The peelable, backing layer of the blister package is generally constructed of a reinforcable sheet material not easily ruptured by forces exerted by the human fingers. The non-rupturing feature of the backing layer particularly provides the blister package with the feature of child resistant. Typical materials of fabrication of the backing layer can be selected from the group consisting of woven, and non-woven materials, long metallic or polymeric fiber, reinforced polymers, and warpknit construction materials. A particularly preferred backing layer material is reinforced polymeric material.

The adhesive layers of the blister package are generally constructed from a thermoplastic, binding material that is heat sealable to ensure that the layers are permanently attached to one another, or a polymeric adhesive know in the art.

Within the area underneath the notch cavity there exists a laminate of the lidding and peelable, backing layers that is adhered together to form a pulling tab. However, outside this area there is no adhesive between the lidding and backing layers. When opening an individual blister cavity, after the barrier strip is removed, the user must grasp the tab and peel the backing layer from underneath the blister cavity to remove the composition. The notch cavity and tab area will generally conform to the shape of a triangle or square.

When the pharmaceutical card is finally assembled, a portion of interior and exterior surfaces of the second side of the card (containing the blister package) will generally be removed, except for outer edges attached to the interior and exterior surfaces, to expose the blister and backing layers of the blister package. The portion of the outer edge of the second side of the card opposite the hinge means, divided by the second, perforation line serves as the barrier strip. The barrier strip being the first manipulation of the card (tearing) necessary to remove the composition from a blister cavity.

The method of opening the individual blister cavities requires a tearing of the barrier strip in the region of the selected cavity. After a portion of the barrier strip is removed, the tab underneath the notch cavity is grasp and peeled away from the notch cavity and towards the composition. Lastly, the composition is pushed from the blister layer side towards the lidding layer to rupture said layer and expose the composition.

It should be understood that the described embodiments of the invention and material of construction of the various layers are for exemplary purposes only and is not to be regarded as limiting the scope of possible materials. One of ordinary skill in the art, after having read the disclosure, will be able to appreciate the physical requirements of each layer and substitute various materials therefor.

What is claimed is:

1. A blister package incorporated into a pharmaceutical treatment card for dispensing a pre-measured dosage of a pharmaceutical composition, the card is characterized as a uniform edge multiple layer laminate assembly comprising proportionally dimensioned first and second sides divided by hinging means, said first and second sides comprising interior and exterior layers, said second side further comprising a blister package affixed between said interior and exterior layers along an edge of the second side opposite the hinging means, said blister package comprising:

(a) a blister layer comprising a plurality of raised blister cavities conforming to the shape of a pharmaceutical composition contained therein;

(b) a lidding layer attached to the blister layer on a side opposite the blister cavities for containing the pharmaceutical composition within the blister cavities;

(c) a peelable backing layer abutting the lidding layer opposite the blister layer;

(d) a plurality of adhesive layers between each of the interior and blister layers, blister and lidding layers, peelable backing and exterior layers, said adhesive layers being suitable for affixing the layers together, except that substantially no adhesive layer is between the lidding and backing layers;

(e) a plurality of first perforation lines being about perpendicular to the hinging means and parallel to one another, said lines extending through the blister, lidding, peelable and adhesive layers, and between each of the blister cavities for separating the individual blister cavities to form quadrants;

(f) a plurality of notch cavities located in the blister layer, each of the notch cavities being adjacent to and associated with each of the blister cavities and located along the first perforation lines, said notch cavities being of equal or less volume to said blister cavities volume, so that a void exists between the notch cavities and the lidding layer at each of the notch cavities;

(g) a continuous second perforation line extending through the blister, lidding, peelable backing, adhesive, interior and exterior layers, and along the uniform edge of the second side opposite the hinging means to form a barrier strip so that a portion of said barrier strip extends through each of the notch cavities, wherein the second perforation line is about perpendicular to and intersects the first perforation line at a notch cavities;

(h) a tab consisting essentially of an area proximal to the notch cavities wherein portions of the lidding layer and backing layers are affixed together by an adhesive;

(i) a barrier strip consisting essentially of a laminate assembly of the interior, exterior, blister, lidding and backing layers adhered together, said barrier strip being an area of the second side of the card parallel and opposite the hinging means, said barrier strip and second side being divided by the second perforation line; and (j) an area of the interior and exterior layers within the second side of the card proximal to the blister package wherein said layers have been removed to expose the blister cavities and notch cavities, and first and second perforated lines, wherein each of the blister cavity being opened by a method of tearing away a portion of the barrier strip to expose a portion of each of the notch cavities, clasping the tab in the region of each of the notch cavities, peeling said backing layer away from the lidding layer and towards the composition to expose the lidding layer, and pushing each of the blister towards the composition to cause the composition to rupture the lidding layer thereby exposing the composition.

2. The blister package according to claim 1, wherein the card comprises a paper board suitable for containing printed indicia on the interior and exterior sides.

3. The blister package according to claim 2, wherein the blister layer comprises a transparent polymeric material.

4. The blister package according to claim 3, wherein the lidding layer comprises a metallic foil material.

5. The blister package according to claim 4, wherein the peelable, backing layer comprises a reinforced paper material.

6. The blister package according to claim 5, wherein the adhesive layers comprise a polymeric binder.

7. The blister package according to claim 6, wherein the transparent polymeric material is selected from the group consisting of low density polyethylene, an olefinic copolymer, and blends thereof.

8. The blister package according to claim 7, wherein the plurality of notch cavities are located in the corners formed by intersections of the first perforation lines and the barrier strip.

9. The blister package according to claim 8, wherein the hinge means comprises a linear crease in the card dividing the first side and the second side thereof and suitable for folding so that first side and second sides are in close proximity to one another and the blister cavities are positioned between the two sides.

10. The blister package according to claim 9, wherein the proportionally dimensioned first and second sides are selected from the group of rectangular, triangular, oval and elliptical shapes.

11. The blister package according to claim 10, wherein the interior and exterior of the second side of the card are removed to expose the blister and backing layers of the blister package surrounding the blister and notch cavities.

12. A blister package incorporated into a pharmaceutical treatment card, the card characterized as a uniform edge, two layer laminate assembly comprising proportionally dimensioned rectangular-shaped first and second sides divided by hinging means, said first and second sides comprising interior and exterior layers, the second side further comprising a blister package affixed between said interior and exterior layers along the outer edge thereof, about parallel and opposite to the hinging means, said blister package comprising:

(a) a blister layer consisting essentially of a plurality of aligned raised blister cavities conforming to the shape of a pharmaceutical composition placed therein selected from the group consisting of pills, tablets and capsules, said aligned cavities being about parallel and adjacent to the outer edge of the second side;

(b) a lidding layer attached to the non-raised, cavities side of the blister layer for encapsulating the pharmaceutical composition therein;

(c) a peelable backing layer abutting the lidding layer opposite the blister layer;

(d) a plurality of adhesive layers between each of the interior and blister layers, blister and lidding layers, and peeable backing and exterior layers, said adhesive layers being suitable for affixing the layers together;

(e) a plurality of first perforation lines being about perpendicular to the hinging means and extending through the blister, lidding, peelable and adhesive layers, and between each of the blister cavities for separating the individual blister cavities to form quadrants;

(f) a plurality of notch cavities located in the blister layer, each notch being adjacent to raised blister cavities, along the first, perforation lines that separate each of the blister cavities, said notch cavities being of equal or less volume than the blister cavities, so that a void exists between the notch cavities and the lidding layer;

(g) a continuous second perforation line extending through the blister, lidding, peelable backing, adhesive, interior and exterior layers, and along the uniform edge of the second side opposite the hinging means to form a barrier strip so that a portion of the barrier strip extends through each of the notch cavities, wherein the second perforation line is about perpendicular to and intersects the first perforation line at notch cavities;

(h) a tab consisting essentially of an area proximal to the notch cavities wherein the lidding and backing layers are affixed together by an adhesive;

(i) a barrier strip consisting essentially of a laminate assembly of the interior, exterior, blister, lidding and backing layers adhered together, said barrier strip being an area of the second side of the card parallel and most opposite the hinging means, said barrier strip and second side being divided by the second perforation line; and (j) a cut out surface of the interior and exterior layers within the second side of the card proximal to the blister package wherein said layers have been removed to expose the blister and notch cavities, first and second perforated lines, wherein each of the blister cavities being opened to expose the composition therein by a method characterized by tearing away a portion of the barrier strip to expose each of the notch cavities, peeling the backing layer away from the barrier strip and towards the composition to expose the lidding layer, and pushing the composition from the blister cavities layer through the lidding layer thereby rupturing the lidding layer to expose the composition.

13. The blister package according to claim 12, wherein the card comprises a paper board suitable for containing printed indicia on the interior and exterior sides.

14. The blister package according to claim 13, wherein the blister layer comprises a flexible, transparent polymeric material selected from the group consisting of low density polyethylene, an olefinic copolymer, and blends thereof.

15. The blister package according to claim 14, wherein the lidding layer comprises a aluminum foil material.

16. The blister package according to claim 15, wherein the backing layer comprises a reinforced paper material.

17. The blister package according to claim 16, wherein the adhesive layers comprise a polymeric binder.

18. The blister package according to claim 17, wherein the area of lidding and backing layers aligned with the notch cavity are affixed together by an adhesive layer.

19. The blister package according to claim 18, wherein the plurality of notch cavities are located in the corners formed by the intersecting first perforation lines and the barrier strip.

20. The blister package according to claim 19, wherein the hinge means comprises a plurality of linear creases in the card dividing the first and the second sides thereof, said hinge means being suitable for folding the sides so that first and second sides are in close proximity to one another and the blister cavities are positioned between the two sides.

21. The blister package according to claim 20, wherein the proportionally dimensioned, rectangular-shaped first and second sides are of equal dimension.

22. The blister package according to claim 21, wherein the interior and exterior of the second side of the card are removed to expose the blister and backing layers of the blister package surrounding the blister cavities and notch cavities.

23. The blister package according to claim 22, wherein the pharmaceutical composition is selected from the group consisting of a pill, capsule or tablet.

24. The blister package according to claim 23, wherein the blister cavities of the package are arranged in 1×4 array.

25. A blister package incorporated into a pharmaceutical treatment card, the card characterized as a uniform edge, two layer laminate assembly comprising proportionally dimensioned rectangular-shaped first and second sides divided by hinging means, said first and second sides comprising interior and exterior layers, the second side further comprising a blister package, wherein the cavities are arranged in a 1×4, array affixed between said interior and exterior layers along the outer edge thereof, about parallel and opposite to the hinging means, said blister package comprising:

(a) a blister layer consisting essentially of a plurality of aligned raised blister cavities conforming to the shape of a pharmaceutical composition placed therein selected from the group consisting of pills, tablets and capsules, said aligned cavities being about parallel and adjacent to the outer edge of the second side, wherein the blister layer is constructed of a material selected from low density polyethylene and olefinic copolymers;

(b) lidding layer attached to the non-raised, cavities side of the blister layer for encapsulating the pharmaceutical composition therein;

(c) a peelable backing layer abutting the lidding layer opposite the blister layer;

(d) a plurality of adhesive layers between each of the interior and blister layers, blister and lidding layers, and peeable backing and exterior layers, said adhesive layers being suitable for affixing the layers together;

(e) a plurality of first perforation lines being about perpendicular to the hinging means and extending through the blister, lidding, peelable and adhesive layers, and between each of the blister cavities for separating the individual blister cavities to form quadrants;

(f) a plurality of notch cavities located in the blister layer, each notch being adjacent to raised blister cavities, along the first, perforation lines that separate each of the blister cavities, said notch cavities being of equal or less volume than the blister cavities, so that a void exists between the notch cavities and the lidding layer;

(g) a continuous second perforation line extending through the blister, lidding, peelable backing, adhesive, interior and exterior layers, and along the uniform edge of the second side opposite the hinging means to form a barrier strip so that a portion of the barrier strip extends through each of the notch cavities, wherein the second perforation line is about perpendicular to and intersects the first perforation line at notch cavities;

(h) a tab consisting essentially of an area proximal to the notch cavities wherein the lidding and backing layers are affixed together by an adhesive;

(i) a barrier strip consisting essentially of a laminate assembly of the interior, exterior, blister, lidding and backing layers adhered together, said barrier strip being an area of the second side of the card parallel and most opposite the hinging means, said barrier strip and second side being divided by the second perforation line; and (j) a cut out surface of the interior and exterior layers within the second side of the card proximal to the blister package wherein said layers have been removed to expose the blister and notch cavities, first and second perforated lines.

wherein each of the blister cavities being opened to expose the composition therein by a method characterized by tearing away a portion of the barrir strip to expose each of the notch cavities, peeling the backing layer away from the barrier strip and towards the composition to expose the lidding layer, and pushing the composition from the blister cavities layer through the lidding layer thereby rapturing the lidding layer to expose the composition.

26. The blister package according to claim 25, wherein the olefinic copolymer is selected from ethylene-vinyl acetate, ethylene-acrylic acid, ethylene-ethyl acrylate polyethylene terephthalate, nylons, and polyesters.

* * * * *